US006421037B1

(12) United States Patent
Chen

(10) Patent No.: US 6,421,037 B1
(45) Date of Patent: Jul. 16, 2002

(54) SILICON-CHIP-DISPLAY CELL STRUCTURE

(75) Inventor: Chih-Liang Chen, Saratoga, CA (US)

(73) Assignee: MicroPixel, Inc., Cupertino, CA (US)

( * ) Notice: Subject to any disclaimer, the term of this patent is extended or adjusted under 35 U.S.C. 154(b) by 0 days.

(21) Appl. No.: 09/286,339

(22) Filed: Apr. 5, 1999

(51) Int. Cl.[7] ..... G09G 3/36
(52) U.S. Cl. ..... 345/92; 345/97; 345/98
(58) Field of Search ..... 340/793; 345/86–102; 359/59, 82

(56) References Cited

U.S. PATENT DOCUMENTS 5,225,823 A * 7/1993 Kanaly ..... 340/793
5,426,526 A * 6/1995 Yamamoto et al. ..... 359/82
5,566,010 A * 10/1996 Ishii et al. ..... 359/59
5,844,538 A * 12/1998 Shiraki et al. ..... 345/98
5,959,598 A * 9/1999 McKnight ..... 345/90
5,977,942 A * 11/1999 Walker et al. ..... 345/97

* cited by examiner

*Primary Examiner*—Steven Saras
*Assistant Examiner*—Srilakshmi K. Kumar
(74) *Attorney, Agent, or Firm*—Davis Chin

(57) ABSTRACT

A Silicon-Chip-Display (SCD) cell structure operable in a field sequential mode for use in liquid crystal display (LCD) devices and a method for operating the same provided. The SCD cell structure is formed of first through third write-enable transistors, first through third storage capacitors, and first through third display-enable transistors. In one preferred embodiment, each of the write-enable transistors is sequentially turned on so to pre-load video data into the corresponding storage capacitors during one color-field time prior to when each of the corresponding display-enable transistors is sequentially turned on for displaying an associated color-field. As a consequence, there is rendered a higher quality video image by allowing the LC response time and/or the light strobing time to be increased.

14 Claims, 7 Drawing Sheets

Figure 4

SILICON-CHIP-DISPLAY CELL STRUCTURE

BACKGROUND OF THE INVENTION

1. Field of the Invention:

In recent years, as notebook computers have become more and more compact and lighter in weight so that they can be easily portable and used almost anywhere, a liquid crystal display has been considered a very important screen display device for holding display data. One conventional display device for holding display data in units of pixels is sometimes referred to as a TFT (Thin-Film-Transistor) active matrix type liquid crystal display device or TFT LCD device which has many pixels arranged in a matrix. A color pixel is formed usually by combining three pixels. However, the size of a conventional TFT LCD device is relatively large when used for the screen display of a notebook computer. In view of its large size, the conventional TFT LCD device can only be fabricated on a piece of large glass substrate with polysilicon thin-film transistors.

As a consequence, there has been developed in the last few years a new class of mini-displays which are based on a single crystal silicon substrate. These newer mini-displays can be manufactured using current CMOS technological processes, which can provide better yield and a higher level circuit integration than the existing TFT LCD devices. These mini-displays are referred to as Silicon-Chip-Display (SCD) devices, which are in essence miniature versions of the TFT LCD device. In fact, the LCD portion of the mini-display is quite similar to that of the TFT LCD device, but is made on a much smaller scale, e.g., on top of a silicon chip. The image on top of the mini-display is typically magnified for viewing by an optical system. Dependent upon the particular application, the optical system may be quite complex.

The specific applications for the SCD devices can be generally classified into three major categories. Firstly, the current important application is the one for use in the area of very large screen projectors in which the size of the display device is on the order of thirty inches or more. Secondly, there is an application for utilization as a desktop computer monitor, where the size of the display device is in the range between seventeen and twenty-one inches. Lastly, the third application for the SCD devices is for use as a portable personal display unit.

2. Description of the Prior Art

There is shown in FIG. 1 a simplified perspective view of a conventional Silicon-Chip-Display (SCD) device 10, labeled "Prior Art," which includes a piece of silicon chip substrate 12, a plurality of bonding pads 14 disposed on its peripheral edges, and a display cell array 16 located in the central part of the substrate 12. A circuit area 18 is positioned around the cell array 16. A top glass cover 20 having a seal-ring 22 is securely mounted over the display cell/the circuit area with a liquid crystal (LC) layer sandwiched therebetween. Typically, the silicon chip substrate 12 has a dimension of less than 20 millimeters on each of its sides. Unlike the prior art TFT-LCD display being operated in the Transmissive Mode, the SCD device is operated in the Reflective Mode due to the fact that the silicon substrate is not transparent to light.

In FIG. 2, there is illustrated a schematic circuit diagram of a conventional SCD cell 24 which is comprised of an access transistor T1*a* having a gate, drain, and source and a large storage capacitor Cs. The gate of the access transistor is connected to a wordline WL. The source of the access transistor is connected to a bitline BL, and its drain thereof is connected to one end of the storage capacitor Cs and to a mirror plate 26. The other end of the capacitor is connected to a ground potential. A top electrode 28 is formed in a spaced-apart relationship to the mirror plate 26 with an LC layer 30 sandwiched therebetween. The mirror plate 26 functions optically as a light reflective mirror as indicated by arrows 29,31 and operates electrically as a LC modulator.

The cell structure 24 of FIG. 2 is sometimes referred to as a DRAM-type cell due to the fact that it resembles closely the one-transistor cell of a conventional DRAM device. However, there are two major factors which render the SCD cell structure to be smaller than the conventional TFT-LCD display device. First, a gate insulating film used for forming the storage capacitor is extremely thin and thus the surface area thereof can be made smaller than the conventional TFT device. Secondly, since the SCD cell is operated in the Reflective Mode rather than in the Transmissive Mode the access transistor can be fabricated at any location under the mirror plate without causing a blockage of light. Further, the SCD cell structure has the advantage of being able to utilize the current CMOS silicon technology so as to fabricate integrated drivers and other integrated circuits onto the silicon substrate, thereby achieving a more compact and highly reliable display device. This cell structure is also called a 1C1M (one-capacitor one-mirror) cell.

In order to generate a color image from the SCD display device, there are various known techniques used dependent upon the type of application. For example, in a large screen projection type color display device there are always used three SCD devices together with precision optics so as to process the three colors, corresponding to red (R), green (G), and blue (B). On the other hand, in a portable type display device where there is a concern for size, weight, and/or cost only one SCD device is used on which is a color image must be generated. In order to achieve the color image for the portable display, there are used three-pixel cells within the SCD device which is then covered with color filters for the corresponding RGB colors. However, the pixel array area becomes then approximately three times larger which is unsuitable for a high yield on the CMOS silicon technology. In addition, the use of color filters makes the standard CMOS silicon process more complex and thus increases cost.

In order to overcome these disadvantages, there have been developed a prior art technique of creating a color image in a one-pixel cell which is referred to as a "Field Sequential" (FS) method. This FS method writes RGB data to each of the one-pixel cells in the pixel array in three sequential operations at three times the clock rate. During each of the three sequential operations, a corresponding RGB light source is activated synchronously.

This FS method will function acceptably as long as the response time of the liquid crystal LC is sufficient enough. If this is the case, then the three sequential colors will be effectively combined into a single color image. Therefore, the effective LC response time for each of colors is ⅓ of the frame time reduced by the amount of time it takes to write a color field. However, a serious problem arises when this FS method is utilized in a relatively large display device. This is because there may not be enough time for the LC to respond. For instance, a standard 60 frames/sec video signal has a total time of 16.67 ms for displaying a frame. In the case of the three-pixel cells where the RGB colors can be processed in parallel, each color has a full frame time so as to process and then display the video data. On the other hand, in the FS operation each of the colors has only ⅓ of the frame time or 5.56 ms in order to write data to the storage capacitors, to then wait for the LC to respond, and to then finally strobe the pixel array with the corresponding RGB light source. The length of time for light strobing (LS) the pixel array will determine the bright of the color image. Consequently, in order to achieve a high quality video in the SCD device operated with the FS method, it has become necessary to effectively increase the LS time.

Accordingly, it is still desirable to provide an improved SCD cell structure operable in a field sequential mode for use in a liquid crystal devices. Further, it would be expedient that the SCD cell structure include circuit means for increasing effectively the length of the LS time. This is achieved in the present invention by the provision of a novel SCD cell structure which includes multiple storage capacitors for storing video data prior to corresponding color-field times for display.

SUMMARY OF THE INVENTION

Accordingly, it is a general object of the present invention to provide an improved SCD cell structure operable in a field sequential mode for use in liquid crystal devices which overcomes the problems of the prior art display devices.

It is an object of the present invention to provide an improved SCD cell structure operable in a field sequential mode for use in liquid crystal devices which has a better yield and a higher level circuit integration than existing display devices.

It is another object of the present invention to provide an improved SCD cell structure operable in a field sequential mode for use in liquid crystal devices which has a higher quality color image than conventional display devices.

It is still another object of the present invention to provide an improved SCD cell structure operable in a field sequential mode for use in liquid crystal devices which includes circuit means for increasing effectively the length of the light strobing time.

In accordance with a preferred embodiment of the present invention, there is provided a Silicon-Chip-Display (SCD) cell structure operable in a field sequential mode for use in liquid crystal display (LCD) devices and a method for operating the same provided. The SCD cell structure is formed of first through third write-enable transistors, first through third storage capacitors, and first through third display-enable transistors. Each of the write-enable transistors is sequentially turned on so to pre-load video data into the corresponding storage capacitors during one color-field time prior to when each of the corresponding display-enable transistors is sequentially turned on for displaying an associated color-field. As a consequence, there is rendered a higher quality video image by allowing the LC response time and/or the light-strobing time to be increased.

BRIEF DESCRIPTION OF THE DRAWINGS

These and other objects and advantages of the present invention will become more fully apparent from the following detailed description when read in conjunction with the accompanying drawings with like reference numerals indicating corresponding parts throughout, wherein.

DESCRIPTION OF THE PREFERRED EMBODIMENTS

Figure 1:
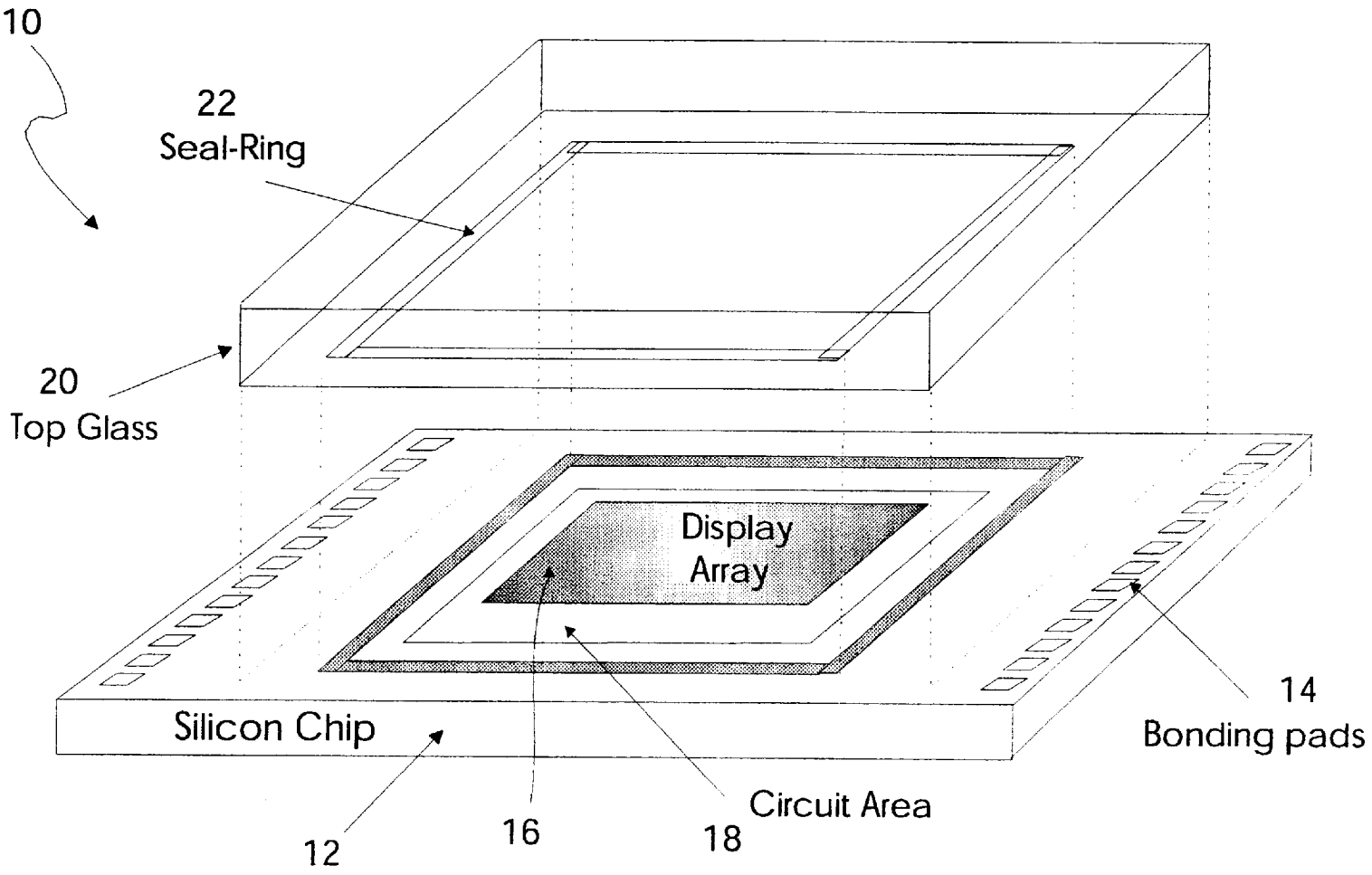
Figure 1 (Prior Art)
FIG. 1 is an exploded, perspective view of a conventional SCD display device.
Figure 2:
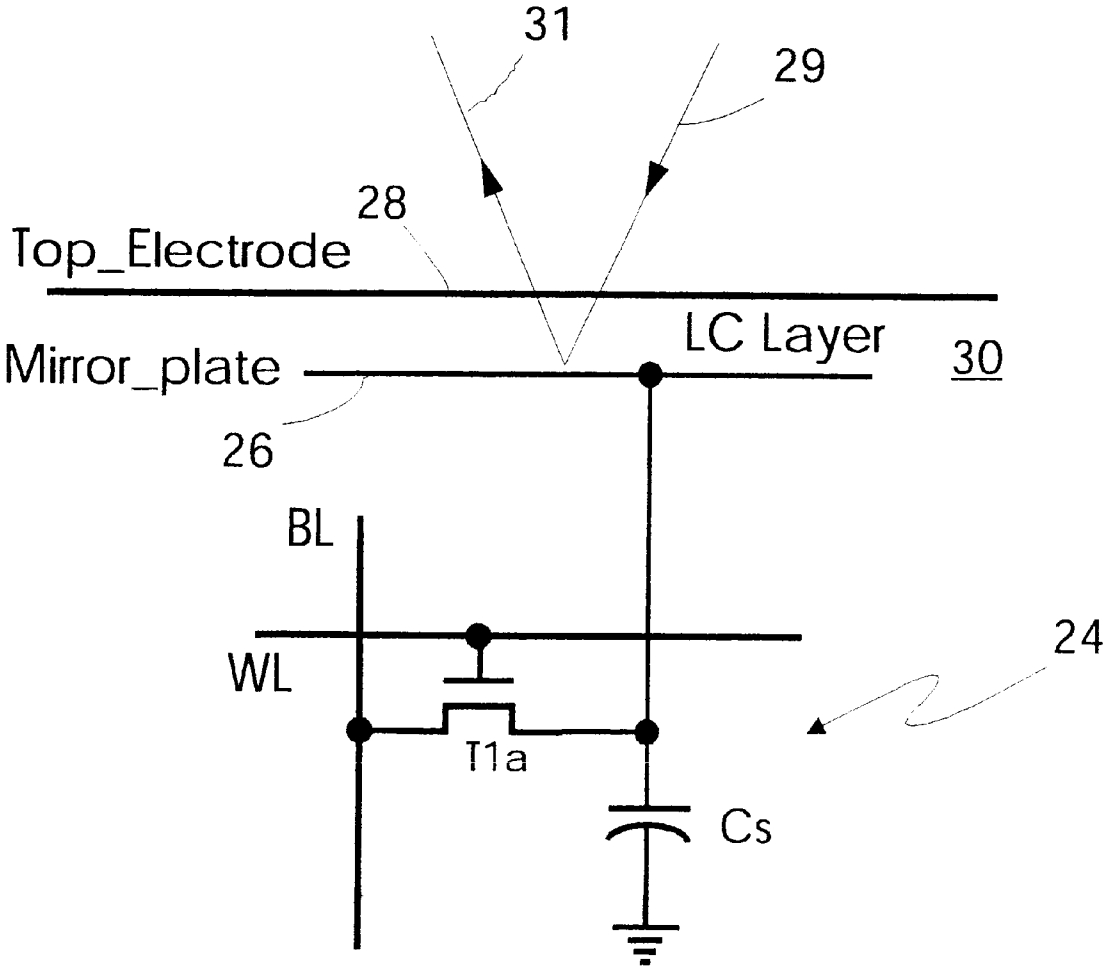
Figure 2 (Prior Art)
FIG. 2 is a schematic circuit diagram of a conventional SCD cell structure of FIG. 1.
Figure 3:
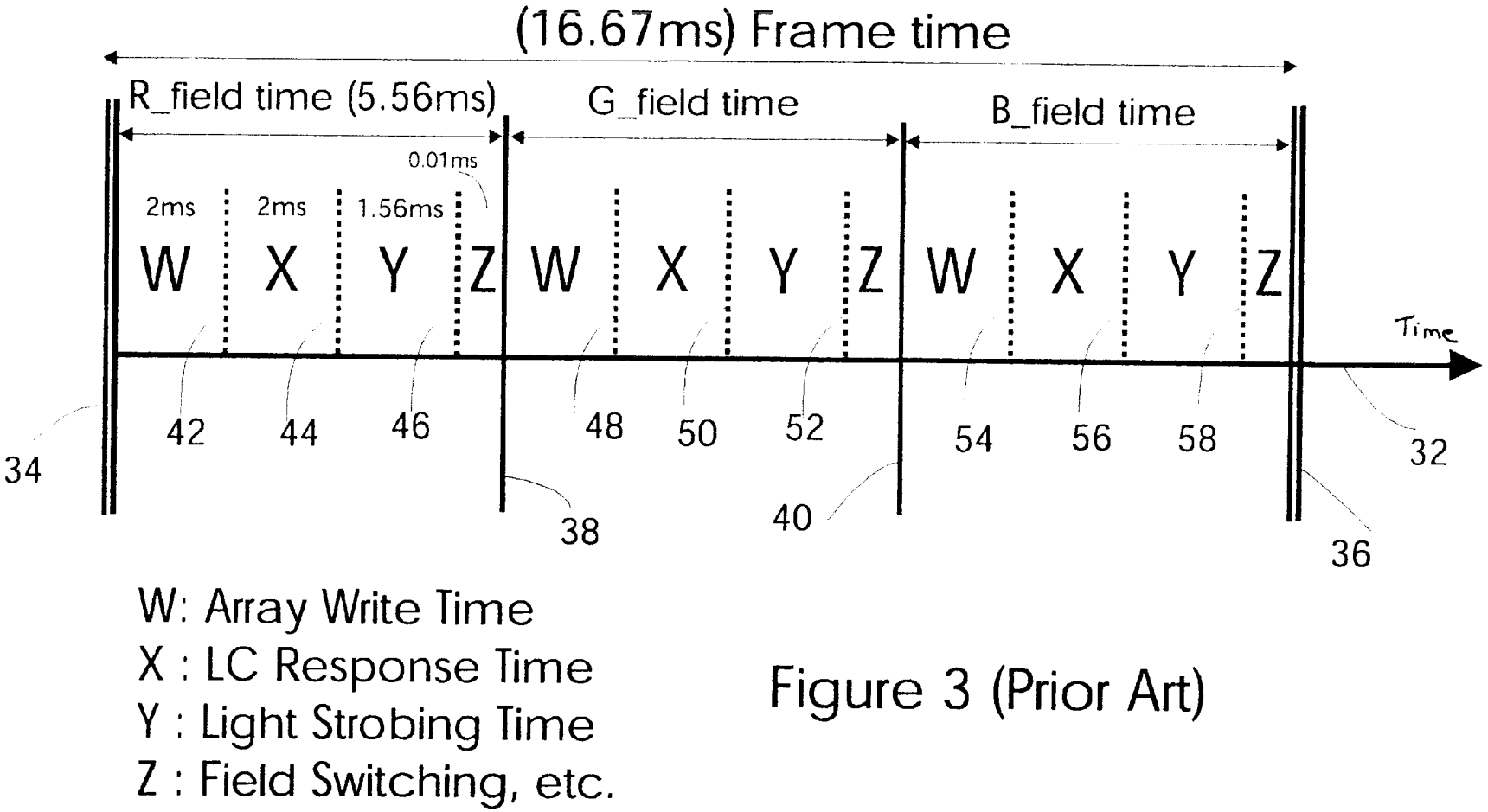
Figure 3 (Prior Art)
FIG. 3 is a timing diagram showing the sequences of operation of the SCD cell structure of FIG. 2 in a field-sequential mode.

Before describing in detail the improved SCD cell structure for use in liquid crystal devices of the present invention, it is believed that it would be helpful in understanding the principles of the instant invention and to serve as a background by explaining initially the timing sequence of a field-sequential (FS) mode of operation in accordance with the conventional SCD cell structure of FIG. 2 with reference to FIG. 3. Thus, the conventional SCD cell structure operated in a FS mode will now be described hereinbelow as well as the problems associated therewith.

As can be seen, the horizontal axis 32 is a plot of time wherein a period bounded by the vertical double-lines 34 and 36 represents a single frame time of 16.67 ms for a standard 60 frames/sec video signal. The frame time is divided into three equal amounts of time (5.56 ms) each defining a color-field time. The red (R) field time is bounded by the double-lines 34 and a single vertical line 38. The green (G) field time is bounded by the single vertical line 38 and another single vertical line 40. The blue (B) field time is bounded by the single vertical line 40 and the vertical double-lines 36. Further, each of the three color-field times are separated into four pipe times W, X, Y, and z by vertical dash-lines 42–46, 48–52, and 54–58, respectively.

The first pipe time W defines an array write time which is the time that it takes to write data into the storage capacitors Cs on a line-by-line basis across the entire SCD display array. The length of the write-time for each line is controlled primarily by the RC time-constants of the rather lengthy wordlines WL and bitlines BL. Of course, the total write-time of the array is dependent upon its size. For example, in an industrial standard VGA array of 640 horizontal lines by 480 vertical lines, the pipe time W would be on the order of 2 ms assuming a writing speed of 4 us/line.

The second pipe time X defines a LC response time which is the time that it takes the liquid crystal to respond to a voltage stored on the storage capacitor Cs. This LC response time can vary greatly since it is dependent upon the composition, type, temperature and the like. The reason for allocating such second pipe time X is to allow time for the LC to respond to the lines that are written later into the field. Without such a buffering time interval, a color cross-talk might occur where the light strobing is performed on a LC cell while it still has data from the previous field.

The third pipe time Y defines a light strobing (LS) time which is the time interval when a corresponding light source is activated or turned on so as to view the image. In order to obtain a brighter image, the pipe time Y should be made as long as possible. Lastly, the fourth pipe time Z is defines a control time which is the time used for field switching, mirror discharging, and generating of other control signals. This pipe time Z is relatively much shorter that the other pipe times W, X, and Y and is on the order of a few microseconds. It is estimated that the pipe times W, X, and Y are approximately 2 ms, 2 ms, and 1.55 ms, respectively.

The disadvantage of this FS mode of operation just described with respect to the prior art one-capacitor one-mirror SCD cell of FIG. 2 is that the sequence of the four pipes times W, X, Y, and Z for the R field-time is then repeated for the G field-time and the B field-time. Thus, a display signal is also turned-on to connect the respective RGB capacitors to the mirror plate for the field time of 5.56 ms each. As a result, there will be a 2 ms pipe time W for each color, thereby preventing the increase of the corresponding pipe time Y within the color-field time. In view of this, the inventor has developed a novel SCD cell structure for field sequential applications in which the pipe time Y in each color-field time can be increased so as to provide a higher quality video.

Figure 4:
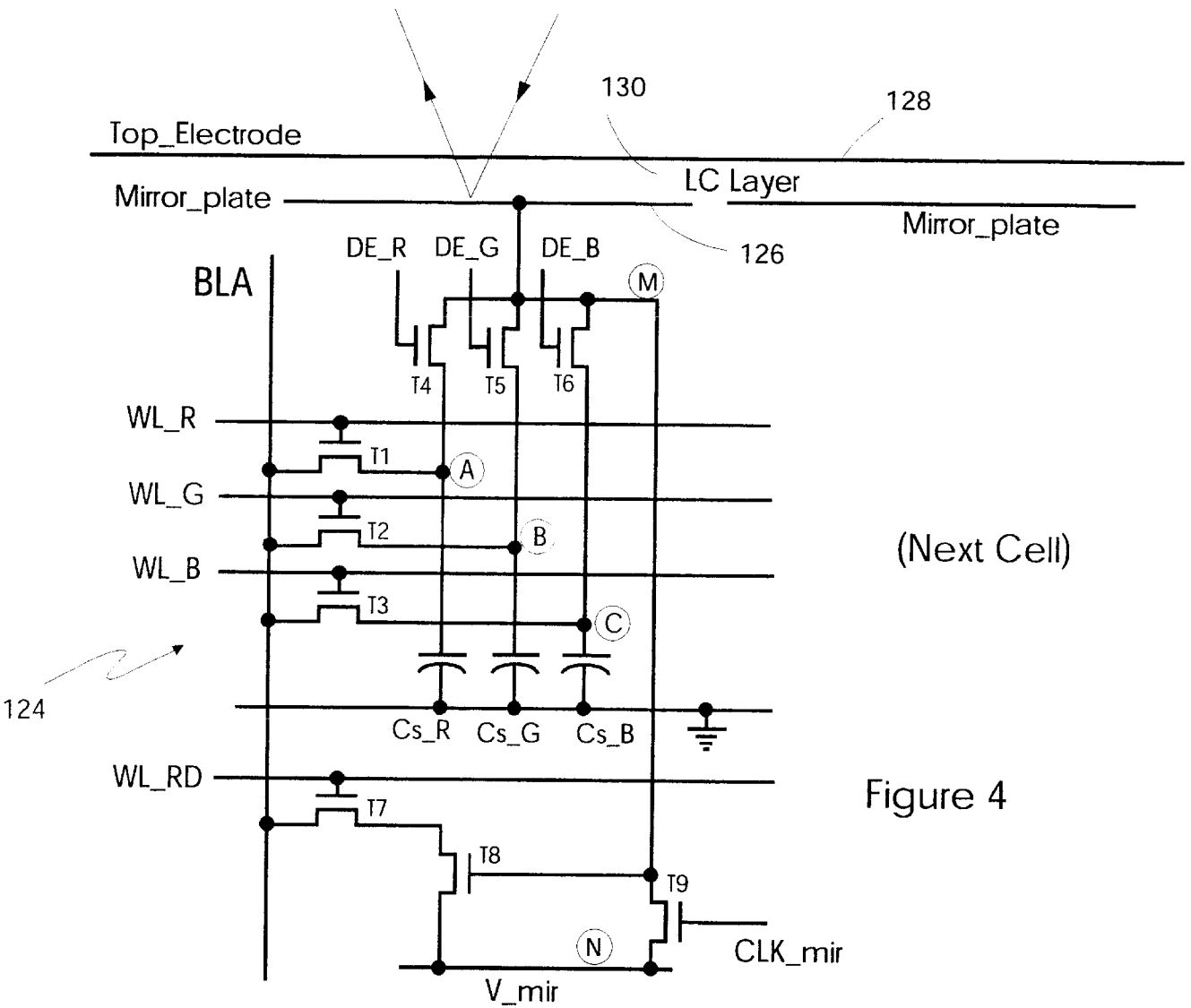
FIG. 4 is a schematic circuit diagram of the improved SCD cell structure, constructed in accordance with the principles of the present invention.

Referring now to FIG. 4, there is shown a schematic circuit diagram of an improved SCD cell structure 124 of the present invention which is comprised of three write-enable transistors T1, T2, and T3 each having a gate, source and drain and three storage capacitors Cs_R, Cs_G, and Cs_B. The gates of the write-enable transistors are connected to corresponding wordlines WL_R, WL_G and WL_B , respectively. The sources of the write-enable transistors are all connected to a single shared bitline BLA. The drains of the transistors T1–T3 are connected to one end of the associated storage capacitors Cs_R, Cs_G, and Cs_B at respective internal nodes A, B, and C. The other ends of the three capacitors are connected to a ground potential.

Further, the SCD cell structure includes three display-enable transistors T4, T5, and T6 each having a gate, source, and drain. The gates of the display-enable transistors are connected to corresponding display-enable lines DE_R, DE_G, and DE_B, respectively. The drains of transistors T4–T6 are connected together at a common node M and to a mirror plate 126. A top electrode 128 is formed in a spaced-apart relationship to the mirror plate 126 with a LC layer 130 sandwiched therebetween. The sources of the display-enable transistors are connected to the respective nodes A, B and C.

For testing purposes, the SCD cell structure 124 also includes a pair of read transistors T7 and T8 which are used to read out the analog voltage stored on the mirror plate 126. In addition, there is provided a discharge transistor T9 for discharging the voltage on the mirror plate during the field switching times prior to switching to another color-field time. This serves to prevent a potential color cross-talk. The transistor T7 has its gate connected to a wordline WL_RD, its source connected also to the bitline BLA, and its drain connected to the source of the transistor T8. The transistor T8 has its gate connected to the source of the transistor T9 and to the common node M. The drain of the transistor T8 is connected to drain of the transistor T9 and to a common node N for receiving a supply potential V_mir. This supply potential V_mir is also applied to the top electrode 128. The gate of the discharge transistor T9 is connected to a clock line CLK_mir.

In order to improve the video quality of the SCD device operated in the field sequential mode, the inventor has designed the novel SCD cell structure 124 with three storage capacitors coupled to the same mirror plate 126. As a consequence, the pipe times W described above with respect to FIGS. 2 and 3 can be hidden in the operation of the present SCD cell of FIG. 4. In other words, video data for the respective storage capacitors can be written therein in advance of the next color-field to be displayed so as to effectively eliminate the pipe times W of the field sequential mode of operation. Therefore, the time saved through elimination of the pipe time W in the color-field times can then be allocated to the other remaining pipe times. In particular, the second pipe time X can be increased to provide a longer LC response time and/or the third pipe time Y can be made larger to generate an increased light-strobing time, thereby enhancing the quality of the color image.

Figure 6:
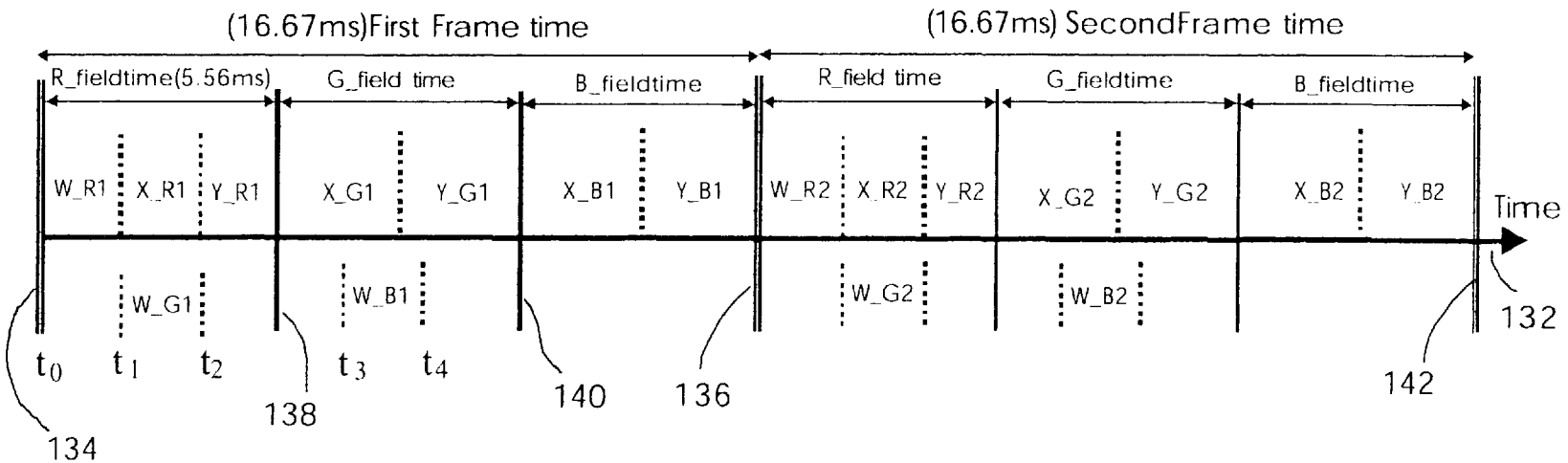
FIG. 6 is a timing diagram showing one embodiment of the sequences of operation of the present SCD cell structure of FIG. 4, in accordance with the present invention.

Referring now to FIG. 6 of the drawings, there is illustrated a timing diagram of a first embodiment of a sequences of operations of the SCD cell structure of FIG. 4 which are implemented in accordance with the teachings of the present invention. As can be seen, the horizontal axis 132 is a plot of time wherein a period bounded by the vertical double-lines 134 and 136 represents a first frame boundary having a time of 16.67 ms for a standard 60 frames/sec video signal. The first frame time is divided into three equal amounts of time (5.56 ms) each defining a color-field time. The first red (R) field time is bounded by the double-lines 134 and a single vertical line 138. The first green (G) field time is bounded by the single vertical line 138 and another single vertical line 140. The first blue (B) field time is bounded by the single vertical line 140 and the vertical double-lines 136.

Based upon a 60 video signal, as will be recalled there is total time of 16.67 ms for displaying a single frame. Since the display time for a frame is assumed to be evenly distributed among the three color-field times (each of 5.56 ms), then the pipe times W_R1, X_R1, Y_R1 and Z_R1 for the red color-field are estimated to be 2 ms, 2 ms, 1.55 ms and 0.01 ms, respectively. Since the pipe time Z_R1 is relatively smaller than the other pipe times, it has been purposely omitted for the convenience of illustration in FIGS. 6 and 7.

In operation, the field sequencing is started at time t0 for writing the red color-field during the first red pipe time W_R1. At this same time t0, the display-enable transistor T4 is sequentially turned ON so as to connect the red storage capacitor Cs_R to the mirror plate 126 for a color-field time of 5.56 ms. Unlike the prior art SCD cell of FIG. 2 where the sequence for writing the red color-field is repeated for the green color-field and the blue color-field (additional 2 ms for each color), the writing times for the green (W_LG1) and blue (W_LB1) color-fields can be hidden by performing the following operations: (1) immediately after the completion of first red pipe time W_R1 for writing the red color-field, writing for the next or green color-field is performed during the first green pipe time W_G1 between the times t1 and t2. As will be noted this is done while the red color-field is waiting for the LC to respond time (X_R1) and during the red light-strobing time (Y_R1). (2) Immediately after the completion of first green pipe time W_G1 for writing the green color-field, it would be theoretically possible to start writing the next or blue color-field beginning at the time t2. However, it can be seen from the timing diagram that there is not a sufficient amount of time to complete the writing for the blue color-field before the end of the red color-field time at the line 138. At the vertical line 138, the display-enable transistor T5 is sequentially switched ON so as to display the green color-field. Therefore, the writing for the blue color-field is delayed and is performed during the first blue pipe time W_B1 between the times t3 and t4 within the green color-field time.

In this manner, by pre-loading the video data at background before the time it is needed for display the SCD cell structure can have longer intervals of time for the LC to respond and the light-strobing. Consequently, it can be seen that there are no green and blue writing pipe times (W_G1, W_B1) within the respective green and blue color-field times, i.e., between the lines 138 and 140 and between the lines 140 and 136. The times saved by eliminating the green and blue writing pipe times can be distributed effectively to enhance the performance of the display, such as by increasing either the LC response time X for one of the RGB colors or the light-strobing time Y for one of the light sources.

After the completion of the first frame time boundary between the double-vertical lines 134 and 136, the timing sequence is repeated for the second frame time boundary between the vertical double-lines 136 and 142. Then, the timing sequence is repeated over and over for the remaining frame time boundaries until all of the frames have been displayed. The writing times saved by utilizing this scheme is 4 ms per frame time or approximately 24% of a frame period.

Figure 7:
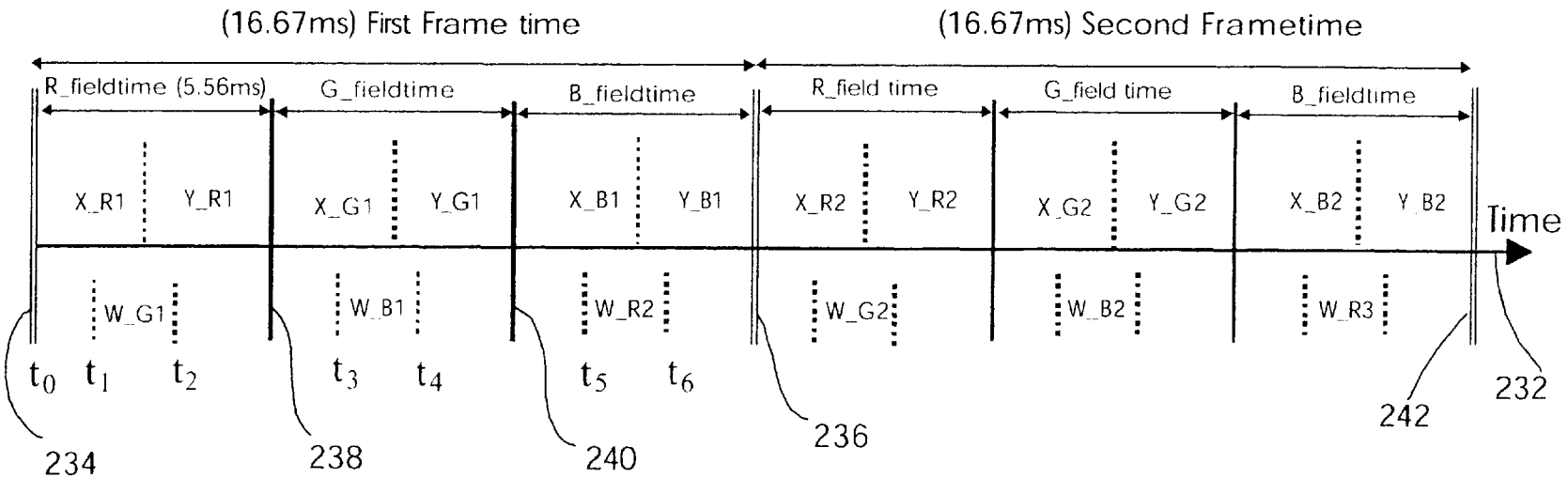
FIG. 7 is a timing diagram showing a second embodiment of the sequences of operation of the present SCD cell structure of FIG. 4, in accordance with the present invention.

Referring now to FIG. 7 of the drawings, there is illustrated a timing diagram of a second embodiment of a sequences of operations of the SCD cell structure of FIG. 4 which are implemented in accordance with the teachings of the present invention. It will be noted that similar reference numerals have been employed to designate corresponding elements to FIG. 6, except increased by 100. The timing diagram of FIG. 7 is substantially identical to the one of FIG. 6, except that the first red pipe time W_R1 for writing the red color-field in the first frame time has been omitted in order to pre-load the video data for the next or green color display field. Thereafter, for the remaining sequences of operation, the data is always pre-loaded one color-field time in advance of when it is to be displayed.

For example, the first green pipe time W_G1 for writing the green color-field is performed between the times t1 and t2 within the red color-field time. Then, the first blue pipe time W_B1 for writing the blue color-field is performed between the times t3 and t4 within the green color-field time. Next, the second red pipe time W_R2 for writing the red color-field (second frame time) is performed between the times t5 and t6 within the blue color-field time of the first frame time. In this fashion, all of the RGB color data are sequentially always pre-loaded into the respective RGB storage capacitors (Cs_G, Cs_B, Cs_R) in advance and are ready for display when the corresponding display-enable transistor (T5, T6, T4) is sequentially activated later on.

This latter sequences of operation of FIG. 7 is a full pipeline scheme of writing the RGB storage capacitors at the field boundary rather the frame boundary, which provides even more writing time savings than in FIG. 6. It will be noted that there are no writing pipe times within the RGB color field-times. In other words, there are only pipe times X and Y appearing in the RGB color field-times. Accordingly, there will be saved 6 ms per frame or 36% of a frame period. It should be clearly understood by those skilled in the art that for the pipeline scheme of FIG. 7 the field sequential operation can be accomplished with only two physical storage capacitors, but with more complex control logic circuits for the display buffers.

Figure 5:
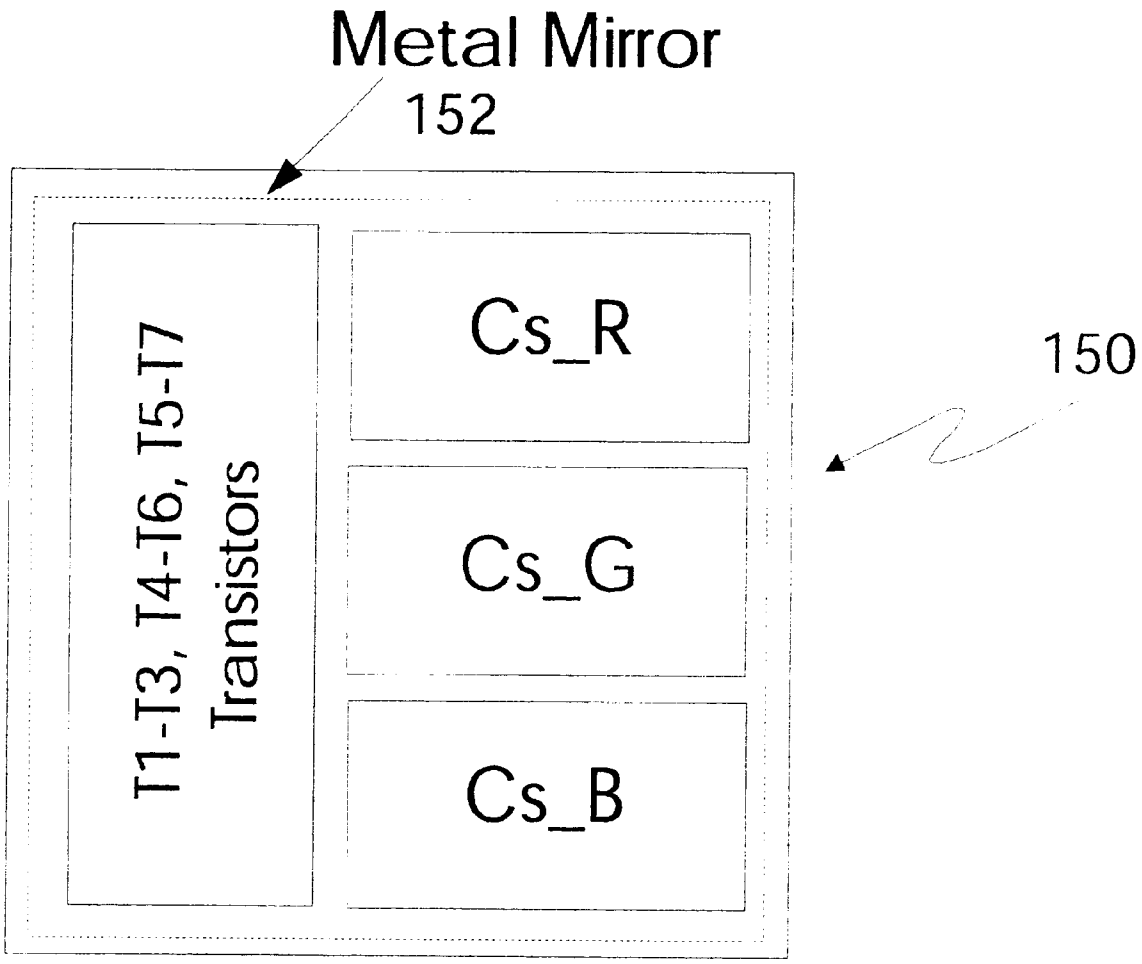
FIG. 5 is a top plan view of a single square pixel of the present invention, illustrating the location of the elements of FIG. 4.

In FIG. 5, there is shown a top plan view of a single square pixel 150, illustrating the arrangements of the circuit components of FIG. 4. The three RGB storage capacitors Cs_R, Cs_G and Cs_B are preferably positioned on the right side of the square pixel. The write-enable transistors T1–T3, display-enable transistors T4–T6, and the read transistors T7, T8 and the discharge transistor T9 are all preferably located on the left side of the pixel. The area of each of the three capacitors is less than the area of the single storage capacitor Cs of FIG. 2. However, by utilizing a suitable CMOS technology, such as a non-volatile, double-polysilicon CMOS technology, a highly reliable capacitor having a high capacitance value can be fabricated. The SCD cell must have a certain minimum size for the mirror plate designated by the dotted line 152 in order to reflective the proper amount of light for viewing the color image. Thus, the minimum dimension on each side is on the order of 20 microns which is sufficiently large enough to accommodate the three storage capacitors when using the current sub-micron CMOS technology.

From the foregoing detailed description, it can thus be seen that the present invention provides a new and novel Silicon-Chip-Display (SCD) cell structure operable in a field sequential mode for use in liquid crystal display (LCD) devices and a method for operating the same provided. The SCD cell structure is formed of first through third write-enable transistors, first through third storage capacitors, and first through third display-enable transistors. In one preferred embodiment, each of the write-enable transistors is sequentially turned on so to pre-load video data into the corresponding storage capacitors during one color-field time prior to when each of the corresponding display-enable transistors is sequentially turned on for displaying an associated color-field. In this manner, there is achieved a higher quality video image since the LC response time and/or the light-strobing time can be increased.

While there has been illustrated and described what is at present considered to be a preferred embodiment of the present invention, it will be understood by those skilled in the art that various changes and modifications may be made, and equivalents may be substituted for elements thereof without departing from the true scope of the invention. In addition, many modifications may be made to adapt a particular situation or material to the teachings of the invention without departing from the central scope thereof. Therefore, it is intended that this invention not be limited to the particular embodiment disclosed as the best mode contemplated for carrying out the invention, but that the invention will include all embodiments falling within the scope of the appended claims.

What is claimed is:

1. A Silicon-Chip-Display (SCD) cell structure operable in a field sequential mode for use in a liquid crystal display (LCD) devices, said SCD cell structure comprising;

a mirror plate;

a top electrode;

a liquid crystal sandwiched between said mirror plate and said top electrode;

first, second and third write-enable transistors, each of said first through third write-enable transistors having a gate, a source and a drain;

first, second and third storage capacitors, each of said first through third storage capacitors having a first end and a second end;

first, second and third display-enable transistors, each of said first through third display-enable transistors having a gate, a source and a drain;

each of said first through third write-enable transistors having its source connected to a shared bitline and having its gate connected to one of three corresponding wordlines;

each of said first through third write-enable transistors having its drain connected to said first end of one of said first through third storage capacitors and to said source of one of said first through third display-enable transistors, said second end of said first through third storage capacitors being connected to a ground potential;

each of said first through third display-enable transistors having its drain connected to said mirror plate and having its gate connected to one of three corresponding display-enable lines; and test circuit means operatively connected for reading a voltage stored on said mirror plate.

2. A SCD cell structure as claimed in claim 1, wherein said test circuit means is comprised of first and second read transistors, each of said first and second read transistors having a gate, a source and a drain.

3. A SCD cell structure as claimed in claim 2, wherein said first read transistor has its gate connected to fourth wordline, its source connected also to said shared bitline and its drain connected to said source of said second read transistor, and second read transistor having its gate connected to said mirror plate and its drain connected to a supply potential.

4. A SCD cell structure as claimed in claim 3, further comprising discharge circuit means operatively connected for discharging said voltage stored on said mirror plate during a field switching time.

5. A SCD cell structure as claimed in claim 4, wherein said discharge circuit means is comprised of a discharge transistor having a gate connected to a clock line, a source connected said supply potential and a drain connected to said mirror plate.

6. A SCD cell structure as claimed in claim 5, wherein each of said write-enable, display-enable, read and discharge transistors is an NMOS type in a CMOS technology.

7. A SCD cell structure as claimed in claim 1, wherein each of said first through third write-enable transistors is sequentially turned on so as to pre-load video data into said corresponding storage capacitors during one color-field time prior to when each of said corresponding display-enable transistors is sequentially turned on for displaying an associated color-field.

8. A SCD cell structure as claimed in claim 1, wherein at least one of said first through third write-enable transistors is sequentially turned on so as to pre-load video data into one of said corresponding storage capacitors during one color-field time prior to when said corresponding display-enable transistor is sequentially turned on for displaying an associated color-field.

9. A method for operating in a field sequential mode a SCD cell structure for use in LCD devices, said SCD cell structure including first through third write-enable transistors, first through third storage capacitors associated with said first through third write-enable transistors for storing video data corresponding to colors of red, green and blue, and first through third display-enable transistors associated with said first through third storage capacitors, comprising the steps of:

providing a frame time being divided equally into a sequence of a red-field time, a green-field time and a blue-field time;

dividing said red-field time into four pipe times consisting of write pipe time, a LC response pipe time, a light-strobing pipe time, and a field switching pipe time;

dividing each of said green-field and blue-field times into only three pipe times consisting of a LC response pipe time, a light-strobing pipe time, and a field switching pipe time;

activating said first write-enable transistor so as to load the video data into said first storage capacitor corresponding to the color of red during the red-field time when said first display-enable transistor is also activated;

activating immediately after completion of the write pipe time of the red-field time said second write-enable transistor to sequentially pre-load the video data into said second storage capacitor corresponding to the color of green during the red-field time so as to be ready for display when said second display-enable transistor is sequentially activated during the green-field time; and activating immediately after completion of the red-field time said third write-enable transistor to sequentially pre-load the video data into the third storage capacitor corresponding to the color of blue during the green-field time so as to be ready for display when said third display-enable transistor is sequentially activated during the blue-field time.

10. A method for operating in a field sequential mode a SCD cell structure as claimed in claim 9, wherein said LC response pipe time for one of the red-field, green-field and blue-field times is increased over the conventional field-sequential operation.

11. A method for operating in a field sequential mode a SCD cell structure as claimed in claim 9, wherein said light-strobing pipe time for one of the red-field, green-field and blue-field times is increased over the conventional field-sequential operation.

12. A method for operating in a field sequential mode a SCD cell structure for use in LCD devices, said SCD cell structure including first through third write-enable transistors, first through third storage capacitors associated with said first through third write-enable transistors for storing video data corresponding to colors of red, green and blue, and first through third display-enable transistors associated with said first through third storage capacitors, comprising the steps of:

providing a frame time being divided equally into a sequence of a red-field time, a green-field time and a blue-field time;

dividing each of said red-field, green-field and blue-field times into only three pipe times consisting of a LC response pipe time, a light-strobing pipe time, and a field switching pipe time;

activating immediately after completion of the blue-field time said second write-enable transistor to sequentially pre-load the video data into said second storage capacitor corresponding to the color of green during the red-field time so as to be ready for display when said second display-enable transistor is sequentially activated during the green-field time;

activating immediately after completion of the red-field time said third write-enable transistor to sequentially pre-load the video data into said third storage capacitor corresponding to the color of blue during the green-field time so as to be ready for display when said third display-enable transistor is sequentially activated during the blue-field time; and activating immediately after completion of the green-field time said first write-enable transistor to sequentially pre-load the video data into the first storage capacitor corresponding to the color of red during the blue-field time so as to be ready for display when said first display-enable transistor is sequentially activated during the red-field time.

13. A method for operating in a field sequential mode a SCD cell structure as claimed in claims 12, wherein said LC response pipe time for one of the red-field, green-field and blue-field times is increased over the conventional field-sequential operation.

14. A method for operating in a field sequential mode a SCD cell structure as claimed in claim 12, wherein said light-strobing pipe time for one of the red-field, green-field and blue-field times is increased over the conventional field-sequential operation.

* * * * *